US006719196B2

(12) United States Patent
Fukuyama

(10) Patent No.: US 6,719,196 B2
(45) Date of Patent: Apr. 13, 2004

(54) CASHDRAWER APPARATUS

(75) Inventor: Shigemitsu Fukuyama, Chigasaki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 282 days.

(21) Appl. No.: 09/840,921

(22) Filed: Apr. 25, 2001

(65) Prior Publication Data

US 2001/0050307 A1 Dec. 13, 2001

(30) Foreign Application Priority Data

Jun. 7, 2000 (JP) ..... 2000-170835

(51) Int. Cl.[7] ..... G07G 1/00
(52) U.S. Cl. ..... 235/7 R; 235/22; 235/10
(58) Field of Search ..... 235/22, 10, 7 R

(56) References Cited

U.S. PATENT DOCUMENTS

| | | | | | |
|---|---|---|---|---|---|
| 3,628,724 | A | * | 12/1971 | Showers, Jr. | 235/22 |
| 4,314,632 | A | * | 2/1982 | Hutchinson | 206/81 |
| RE32,456 | E | * | 7/1987 | Ishii | 200/61.61 |
| 5,451,753 | A | * | 9/1995 | Leatherwood et al. | 235/7 R |
| 5,756,977 | A | * | 5/1998 | Biss | 235/7 R |
| 6,105,858 | A | * | 8/2000 | Chien | 232/1 D |
| 6,152,366 | A | * | 11/2000 | Maddox et al. | 235/381 |

* cited by examiner

*Primary Examiner*—Karl D. Frech
(74) *Attorney, Agent, or Firm*—McDermott, Will & Emery

(57) ABSTRACT

A banknote holder is installed to a cash casing in a cantilever fashion. Some banknotes are stored on the banknote holder while other banknotes are stored beneath the banknote holder. A banknote depressor of the banknote holder depresses the banknotes stacked on the banknote holder.

5 Claims, 10 Drawing Sheets

3071
307
3072
HOOK OPPOSED ANGLE
180° ±20°

3072
307
3071
1.55 ±0.25 mm
(25.0 ~ 26.0) mm
5.2 ±0.2 mm
7.0 ±0.3 mm

3071
OFFSET INWARD
0.0 ±4
7.0 ±0.3 mm

CASHDRAWER APPARATUS

BACKGROUND OF THE INVENTION

This invention relates to a cashdrawer apparatus serving as a POS terminal in a shop or the like.

FIG. 8 is an exploded perspective view showing a conventional cashdrawer apparatus.

A drawer 201 is equipped with rollers 203 provided at a rear end thereof. The rollers 203 are rotatably supported by means of nuts 204. A boxlike cashdrawer body 4 has an opening or aperture at its front end and has a hollow space therein. The drawer 201 is slidably inserted into or pulled out of the cashdrawer body 4, being guided by rollers 401 provided at inside walls of the cashdrawer body 4.

A cash casing 301 is placed in the drawer 201. A coin casing 302 is detachably assembled in a laterally extending front space of the cash casing 301. A banknote depressor 306 is swingably supported at a front end of a fixing plate 305 for holding banknotes or the like stored in the cash casing 301.

A microswitch 1011 performs counting operation in response to open and close operation of the drawer 201. The microswitch 1011 detects the number of times the drawer is opened or closed. The detected number of times is transmitted from the terminal (i.e., the cashdrawer apparatus) to an operation center (not shown), such as an administration office of a fast food chain, via a cable 107.

A banknote depressing spring 307, connected to the fixing plate 305 at its upper end and connected to the central portion of the banknote depressor 306 at its lower end, resiliently depresses the banknotes or the like accommodated in the cash casing 301. A partition wall 304 separates the inside space of the cash casing 301 into a plurality of subsections each extending in the back-and-forth direction (i.e., a sliding direction of the drawer 201). Each subsection has a size substantially equivalent to the banknotes stored in this cashdrawer apparatus, so that an operator can sort banknotes according to their kinds. Furthermore, a bottom space beneath the coin casing 302 allows the operator to store additional banknotes.

The microswitch 1011 is fixed via an insulating plate 1013 to a bracket 104 by means of screws 1012. A solenoid 109 is also fixed to the bracket 104 by means of screws 1010.

A drawer opening spring 1016, provided at the behind side of the drawer 201, resiliently urges the drawer 201 so that the drawer 201 can be smoothly pulled out of the cashdrawer body 4 when the drawer 201 is unlocked. The drawer opening spring 1016 is fixed via a rubber member 1015 to a fixing plate 1014 by means of a screw 1017.

FIG. 9 shows an opened position of a drawer open-and-close mechanism of the above-described conventional cashdrawer.

To close the drawer 201, the operator pushes a push plate 209 located at a behind side of the drawer 201. The push plate 209 shifts in a direction shown by an arrow (i.e., in the left direction). The push plate 209 pushes a swing lever 102. The swing lever 102 swings about its swing shaft 101 in the counterclockwise direction against a resilient force of a spring 105. A protrusion 1030 depresses a microswitch lever 1018 to shift a contact of the microswitch 1011 to a closed (i.e., ON) position. In response to each depression of the microswitch lever 1018, the microswitch 1011 counts the number of times the drawer 201 is opened or closed.

FIG. 10 shows a closed position of the drawer open-and-close mechanism of the above-described conventional cashdrawer. When the drawer 201 is completely closed, the swing lever 102 engages with a solenoid open lever 103. In this closed position, the protrusion 1030 does not depress the microswitch lever 1018. Thus, the contact of the microswitch 1011 returns to an opened (i.e., OFF) position.

A key cylinder 205 is provided at an appropriate portion on a decorative panel 202 attached on the front wall of the drawer 201. When the operator inserts a key in the key cylinder 205 and turns the key to open the drawer 201 from the closed condition shown in FIG. 10, a drawer open lever 2011 shifts in a direction shown by an arrow (i.e., in the left direction) and pushes the solenoid open lever 103. The swing lever 102 is disengaged from the solenoid open lever 103 and swings about the swing shaft 101 in the clockwise direction due to the resilient force of the spring 105. The swing lever 102 disengages from the push plate 209. Thus, the drawer 201 can be opened.

According to the above-described conventional cashdrawer apparatus, the swing lever 102 is directly brought into contact with the push plate 209. When the operator pushes the drawer 201, the microswitch lever 1018 may be erroneously depressed several times. This will induce chattering of the microswitch 1011. The chattering phenomenon causes a problem that the count value of the microswitch 1011 does not correctly agree with actual open or close operations of the drawer 201.

SUMMARY OF THE INVENTION

In view of the foregoing problems, the present invention has an object to provide a banknote holder installable or addable to a conventional cashdrawer apparatus when new kinds of banknodes are issued.

Another object of the present invention is to prevent an operator from being injured by a sharp edge of a banknote depressing spring.

Another object of the present invention is to realize easy insertion of banknotes into a front dead space of a cash casing.

Another object of the present invention is to eliminate the chattering of a microswitch which counts the number of times the drawer is opened or closed.

To accomplish the above and other related objects, the present invention provides a first cashdrawer apparatus comprising a cash casing for storing banknotes, wherein a banknote holder is installed to the cash casing in a cantilever fashion. The banknote holder partitions banknotes stored in the cash casing so that some banknotes can be stored on the banknote holder while other banknotes can be stored beneath the banknote holder. And, the banknote holder depresses the banknotes stacked on the banknote holder.

According to the first cashdrawer apparatus, when new kinds of banknotes are issued, a conventional cashdrawer apparatus can be continuously used by additionally installing the banknote holder of the present invention.

According to the first cashdrawer apparatus, it is preferable that the first cashdrawer apparatus further comprises a banknote depressing spring assembled in the banknote holder for giving a resilient force for depressing the banknotes stacked on the banknote holder. A hook is equipped at one end of the banknote depressing spring. A diameter of the banknote depressing spring is larger than a diameter of a main body of the banknote depressing spring. The hook has a hook end directed upward so as to prevent an operator's finger from being injured by the hook end when the banknotes are stored in or taken out of the cash casing.

Furthermore, the present invention provides a second cashdrawer apparatus comprising a coin casing serving as part of a cash casing. A banknote insertion slit laterally extends as a clearance between the coin casing and the cash casing.

With this arrangement, the operator can easily insert banknotes into a front dead space of the cash casing.

According to the first and second cashdrawer apparatus, it is preferable that a balance weight is provided at a rear side of a cashdrawer body so as to prevent the cashdrawer from leaning forward, and the balance weight is positioned so as not to cause interference with a drawer open-and-close mechanism.

Furthermore, the present invention provides a third cashdrawer apparatus comprising a push plate located at a rear end of a drawer, a swing lever positioned near the push plate and swingable about a swing shaft when the swing lever is pushed by the push plate, and an operation lever engageable with an engaging shaft of the swing lever so as to shift in a predetermined direction during a swing motion of the swing lever. The operation lever disengages from the engaging shaft of the swing lever when the drawer is closed. A microswitch is operative in response to a shift motion of the operation lever for counting the number of times the drawer is opened or closed. Thus, the microswitch is depressed only when the engaging shaft is brought into contact with the operation lever, thereby preventing chattering of the microswitch.

BRIEF DESCRIPTION OF THE DRAWINGS

The above and other objects, features and advantages of the present invention will become more apparent from the following detailed description which is to be read in conjunction with the accompanying drawings, in which.

DESCRIPTION OF PREFERRED EMBODIMENT

Figure 8:
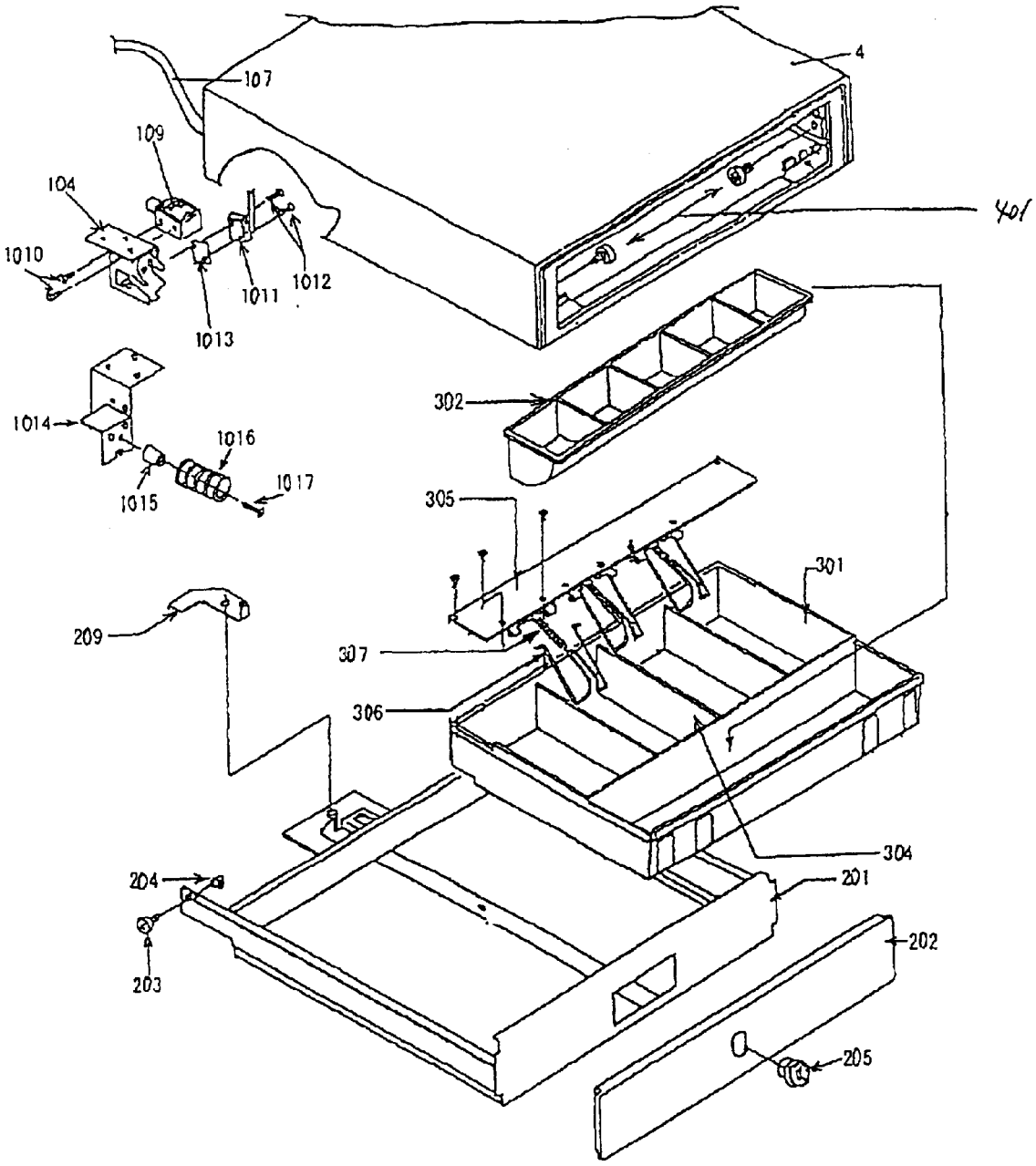
FIG. 8 PRIOR ART
FIG. 8 is an exploded perspective view showing a conventional cashdrawer apparatus.
Figure 9:
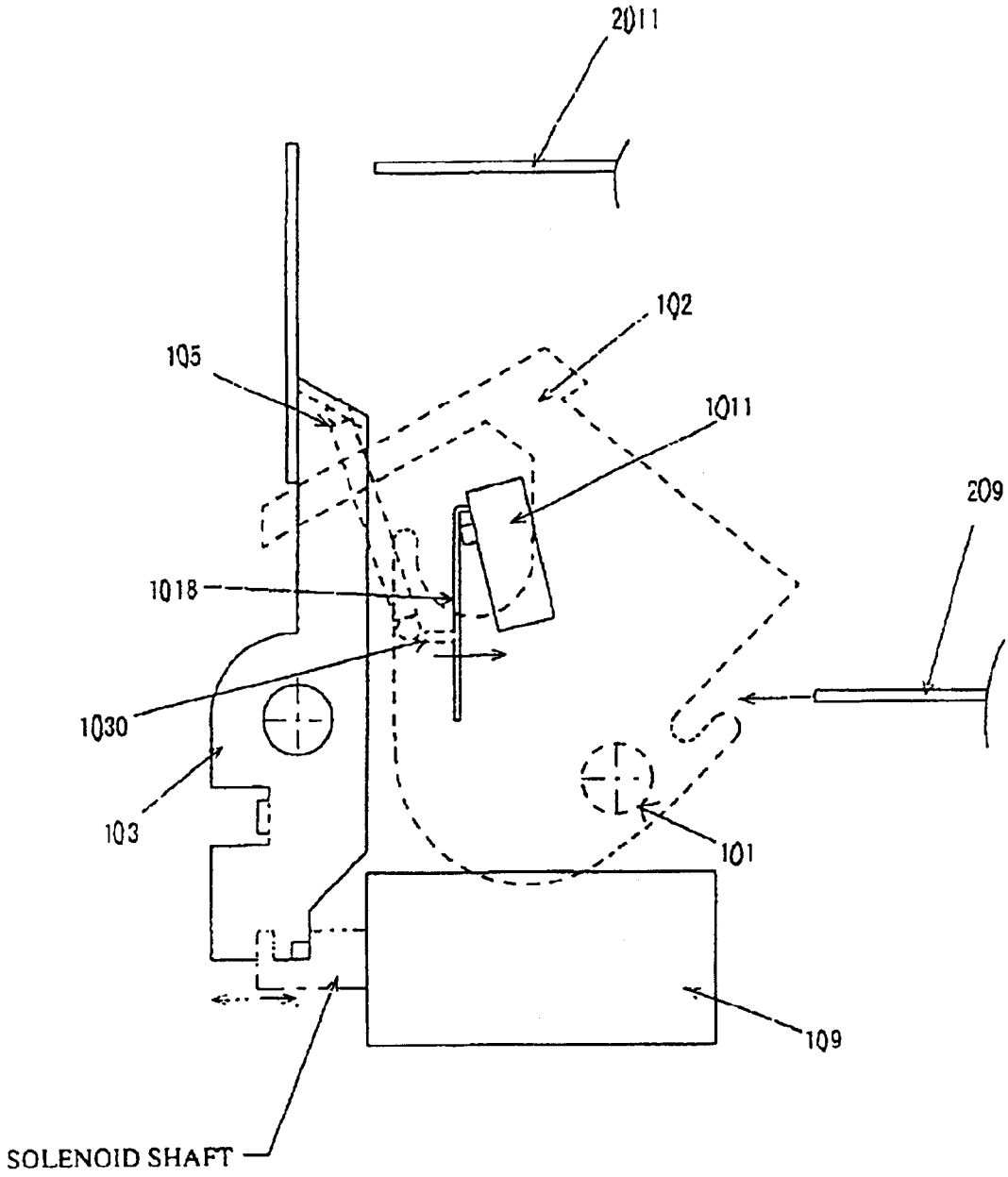
FIG. 9 PRIOR ART
FIG. 9 is a positional relationship between a microswitch and a drawer open-and-close mechanism, in an opened condition of a drawer, in accordance with the conventional cashdrawer apparatus.
Figure 10:
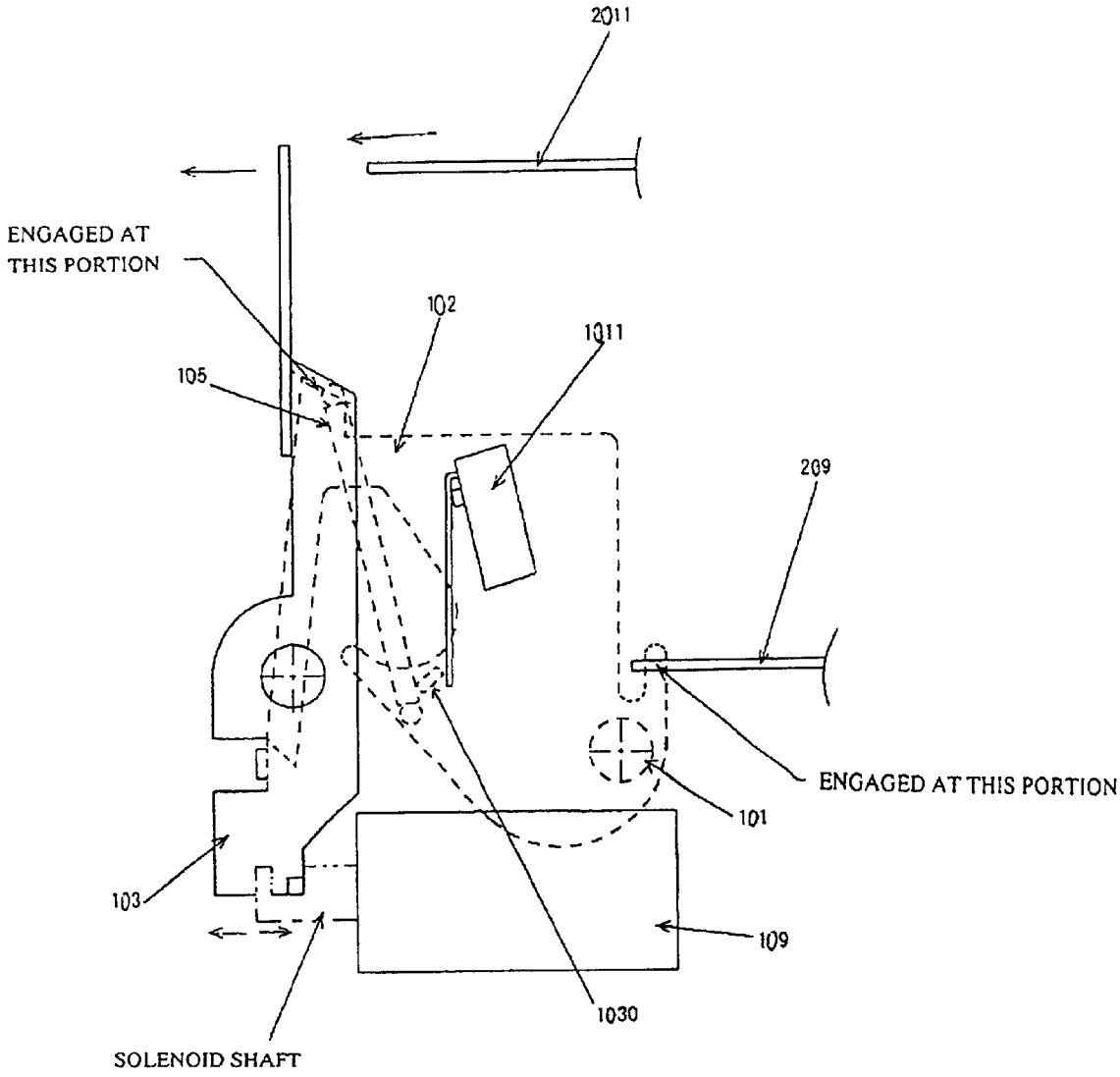
FIG. 10 PRIOR ART
FIG. 10 is a positional relationship between the microswitch and the drawer open-and-close mechanism, in a closed condition of the drawer, in accordance with the conventional cashdrawer apparatus.

Hereinafter, a preferred embodiment of the present invention will be explained with reference to FIGS. 1A to 7. Components or parts corresponding to those disclosed in the above-described conventional cashdrawer apparatus shown in FIGS. 8 to 10 are denoted by the same reference numerals.

Figure 1A:
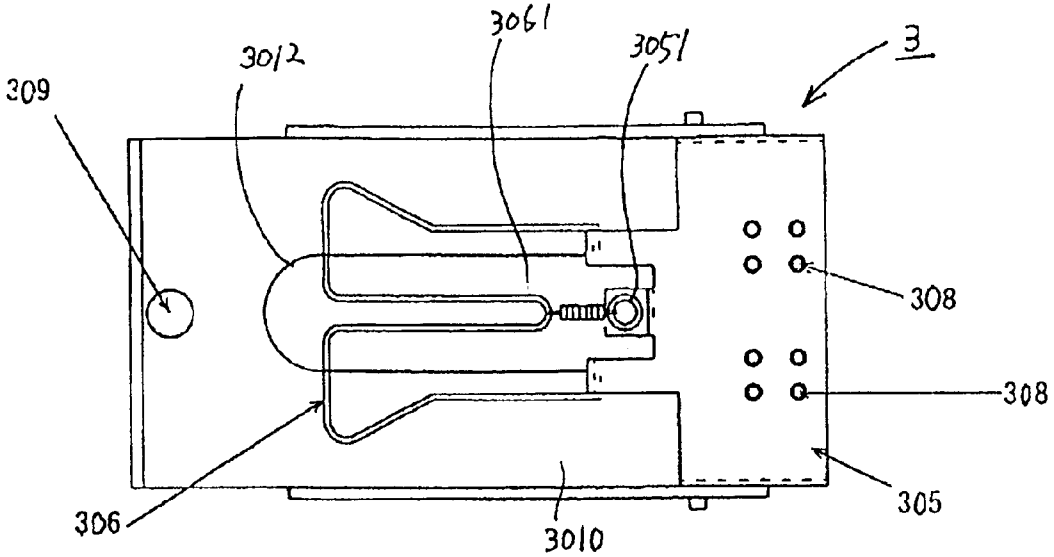
FIG. 1A is a plan view showing a banknote holder with a banknote depressor in accordance with a preferred embodiment of the present invention, which is installable in a cashdrawer apparatus.
Figure 1B:
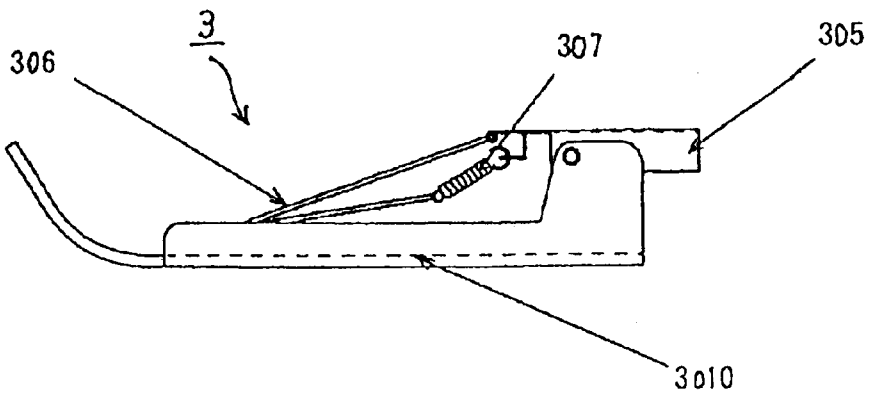
FIG. 1B is a side view showing the banknote holder with the banknote depressor in accordance with the preferred embodiment of the present invention.

FIGS. 1A and 1B cooperatively show an arrangement of a banknote holder equipped with a banknote depressor for depressing and partitioning banknotes stacked on a holder plate. FIG. 1A is a plan view of the banknote holder, and FIG. 1B is a side view of the banknote holder. A banknote holder 3 has a holder plate 3010 which is fixed to a fixing plate 305 by means of screws or equivalent fastener inserted into holes 308. The banknote depressor 306 is hingedly supported at a front end of the fixing plate 305. The banknote depressor 306 is a frame member comprising both ends serving as hinges, a wide U-shaped side frame, and a narrow U-shaped central frame 3061 as shown in FIG. 1A. The narrow U-shaped central frame 3061 of the banknote depressor 306 declines so as to be offset downward relative to a plane defined by the rest of the frame.

Figures 3A, 3B, 3C:
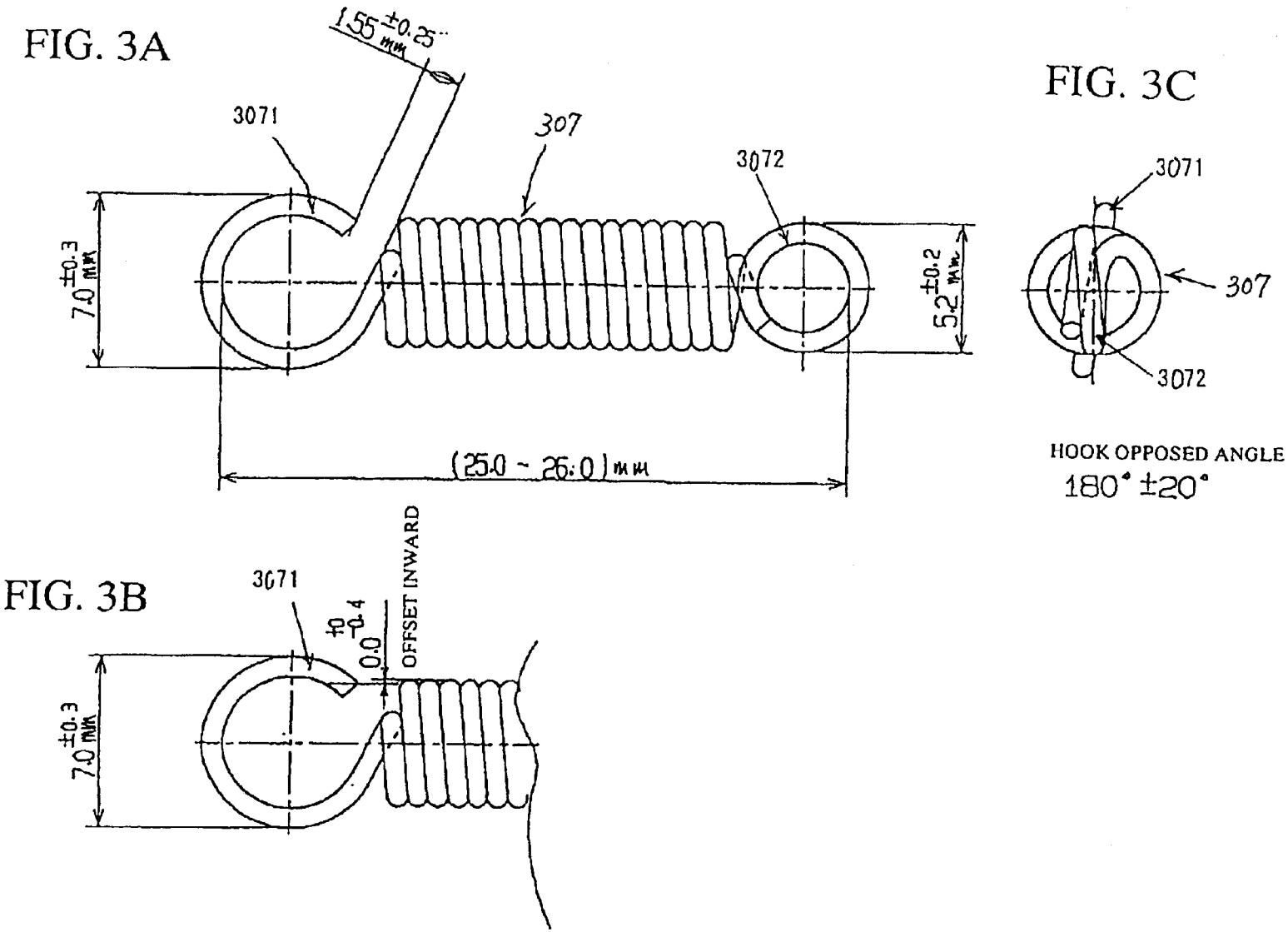
FIG. 3A is a front view showing a banknote spring of the banknote holder in accordance with the preferred embodiment of the present invention.
FIG. 3B is a front view chiefly showing a hook of the banknote spring in accordance with the preferred embodiment of the present invention.
FIG. 3C is a side view showing the banknote spring of the banknote holder in accordance with the preferred embodiment of the present invention.

A banknote depressing spring 307 connects the U-shaped central frame 3061 of the banknote depressor 306 to the front end of the fixing plate 305. As shown in FIGS. 3A to 3C, the banknote depressing spring 307 has a circular hook 3071 at one end thereof and a circular fixing ring 3072 at the other end thereof. The hook 3071 has a hook end being directed upward. The hook 3071 is engaged in a hole 3051 opened at the front end of the fixing plate 305. The fixing ring 3072 is connected to the rearmost end of the narrow U-shaped central frame 3061 of the banknote depressor 306.

The holder plate 3010 has a front end part curved or curled upward so as to have a predetermined radius of curvature. The curved front end part of the holder plate 3010 has a function of guiding banknotes inserted or stored in a dead space beneath the holder plate 3010.

The holder plate 3010 has a hole 309 at the front end part into which the operator can insert his/her finger when the operator takes out the banknotes stored beneath the holder plate 3010. The holder plate 3010 has a cutout 3012 at the bottom part thereof through which the operator can check the presence of any banknote stored beneath the holder plate 3010.

Figure 2:
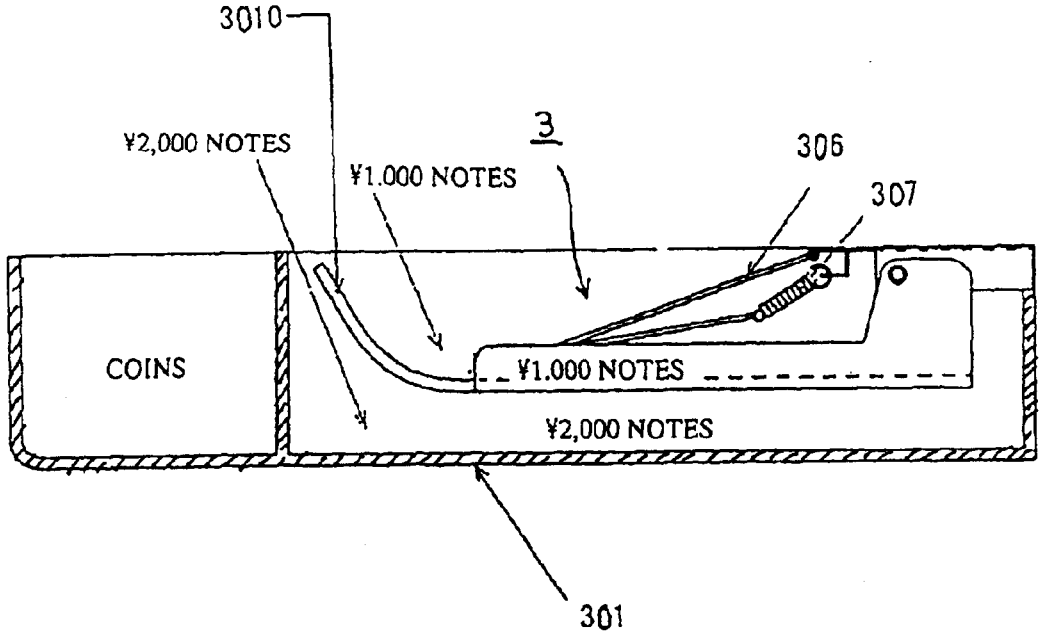
FIG. 2 is a cross-sectional side view showing a cash casing into which the banknote holder is installed in accordance with the preferred embodiment of the present invention.

FIG. 2 is a cross-sectional vide view of the cash casing 301 equipped with the banknote holder 3. As apparent from FIG. 2, the banknote holder 3 is installed to the cash casing 301 in a cantilever fashion. Namely, the rear end of the banknote holder 3 is fixed to the rear wall of the cash casing 301. In other words, the banknote holder 3 of this embodiment is very useful in that the banknote holder 3 can be directly installed in a conventional cashdrawer apparatus.

In Japan, ¥2,000 notes have been recently issued as new kinds of banknotes. For example, to classify or sort the banknotes in the cash casing 301, the operator stores ¥1,000 notes in an upper space on the holder plate 3010 and stores ¥2,000 notes in a lower space beneath the holder plate 3010. In this case, ¥2,000 notes slip into the lower space while being guided by the curved front end of the holder plate 3010. To store ¥1,000 notes, the operator first raises a distal end (i.e., a free end) of the banknote depressor 306 upward against the resilient force of the banknote depressing spring 307. The banknote depressor 306 swings upward about its hinge center. Holding the banknote depressor 306 in a lifted condition, the operator places ¥1,000 notes on the holder plate 3010. And then, the operator lowers or returns the banknote depressor 306 to the home position. Thus, ¥1,000 notes can be firmly held on the holder plate 3010 by the banknote depressor 306.

As described above, the hook 3071 of the banknote depressing spring 307 is directed upward. Thus, it becomes possible to prevent an operator's finger from being injured by a sharp edge of the hook 3071.

Furthermore, as shown in FIG. 3A, a diameter of the circular hook 3071 is larger than a diameter of the circular fixing ring 3072 formed at the lower end of the banknote depressing spring 307. More specifically, as shown in FIG. 3C, the diameter of the circular hook 3071 is larger than a diameter of the main body of the banknote depressing spring 307. The diameter of the circular fixing ring 3072 is substantially identical with the diameter of the main body of the banknote depressing spring 307.

Furthermore, as shown in FIG. 3B, the hook end of the hook 3071 is radially offset inward relative to the main body of the banknote depressing spring 307. In other words, a clearance between the hook end and the central axis of the banknote depressing spring 307 is shorter than a radius of the main body of the banknote depressing spring 307.

Figure 4B:
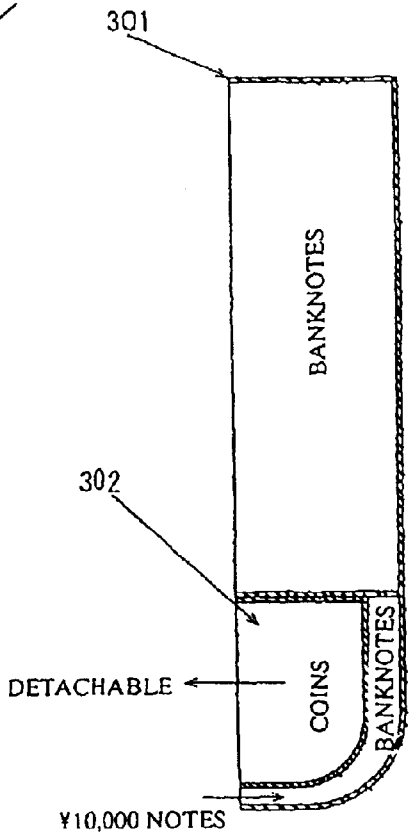
FIG. 4B is a cross-sectional side view showing the cash casing taken along a line A—A of FIG. 4A.
Figure 4A:
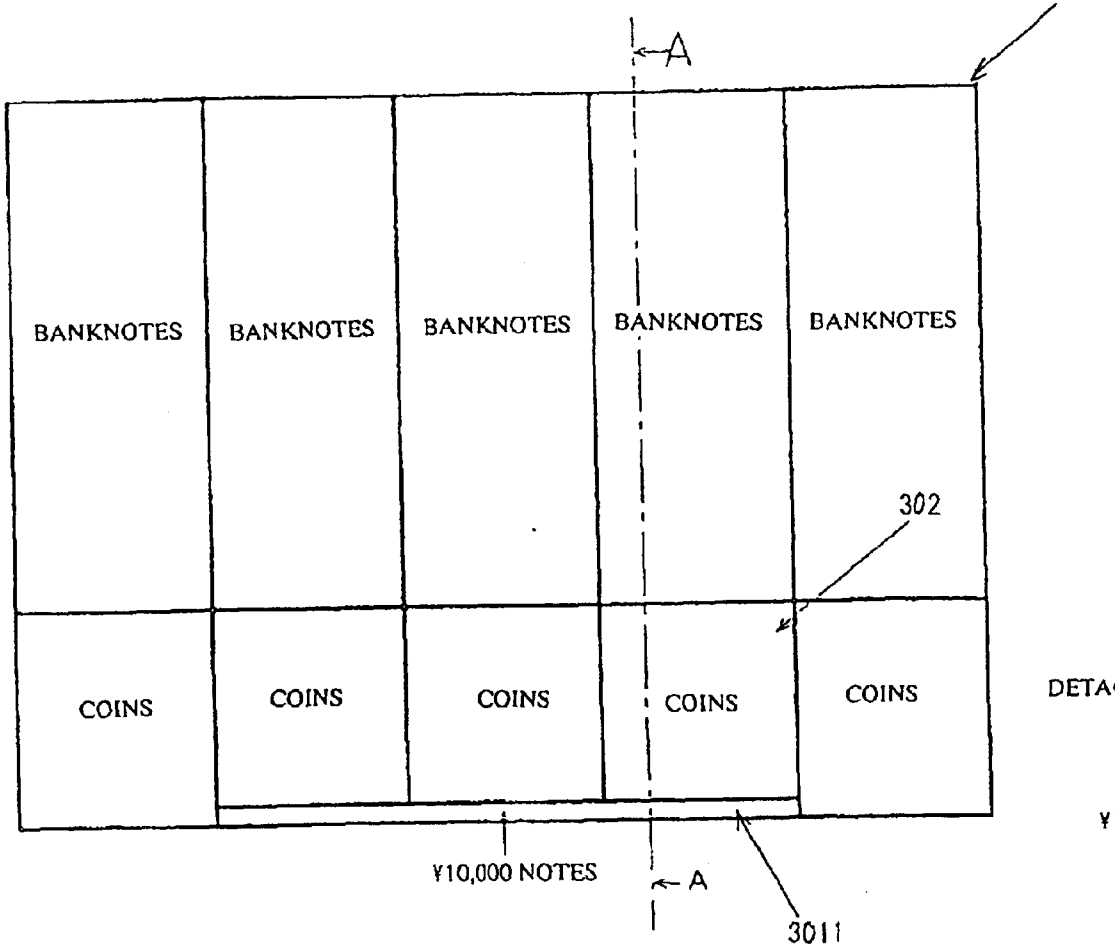
FIG. 4A is a plan view showing the cash casing in accordance with the preferred embodiment of the present invention.

FIGS. 4A and 4B show an arrangement of the cash casing 301. As shown in FIG. 4A, a banknote slit 3011 is provided between the front end wall of the cash casing 301 and the coin casing 302. In other words, the banknote slit 3011 laterally extends in front of the coin casing 302, for example, for storing another banknotes, such as ¥10,000 notes.

As shown in FIG. 4B, the coin casing 302 stores coins and is detachably assembled with the cash casing 301.

Figures 5A, 5B, 5C:
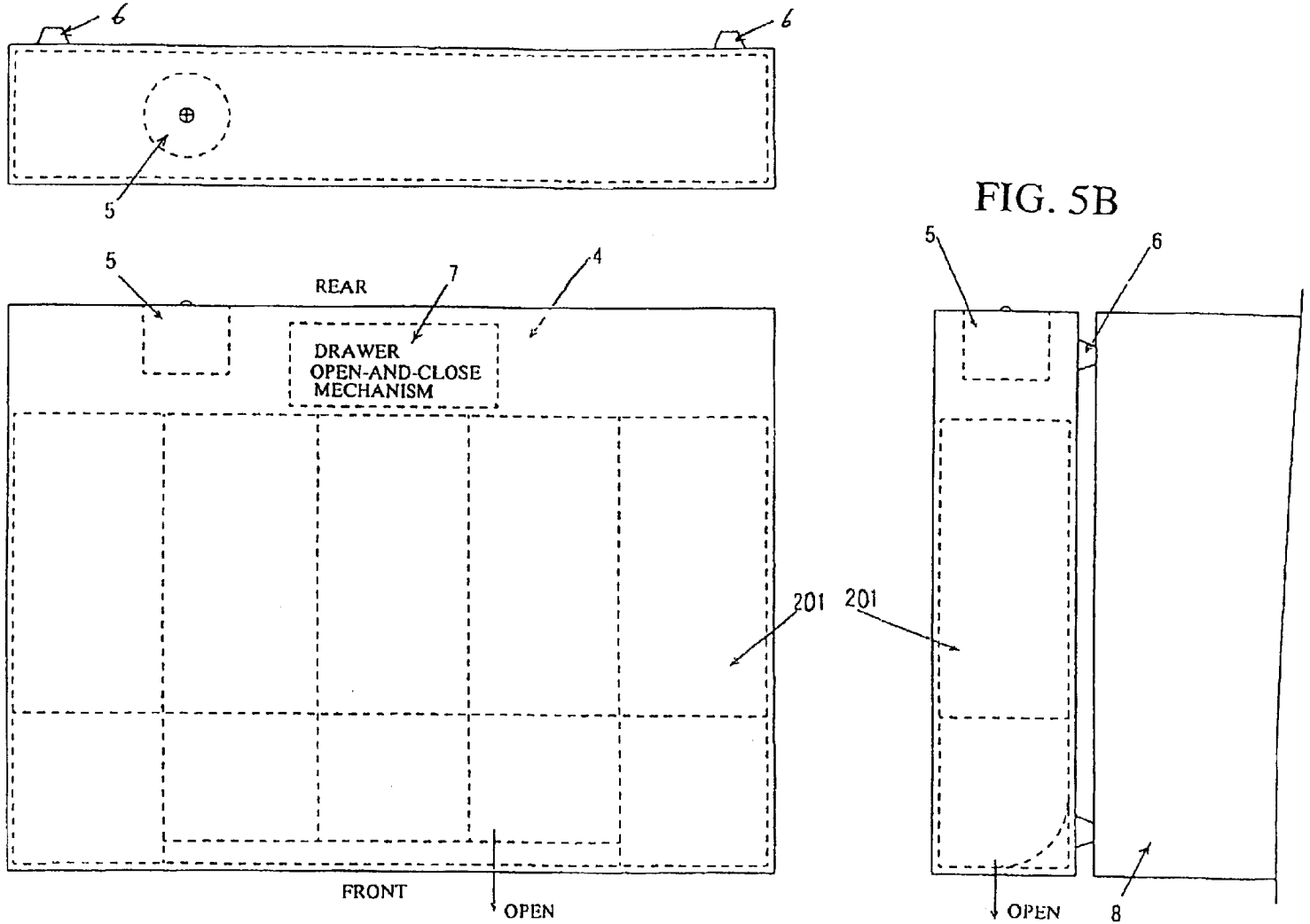
FIG. 5A is a plan view showing a balance weight provided in a cashdrawer apparatus in accordance with the preferred embodiment of the present invention.
FIG. 5B is a side view showing the balance weight provided in the cashdrawer apparatus in accordance with the preferred embodiment of the present invention.
FIG. 5C is a rear view showing the balance weight provided in the cashdrawer apparatus in accordance with the preferred embodiment of the present invention.

As shown in FIGS. 5A to 5C, a balance weight 5 is fixed to a rear end wall of the drawer 201. A plurality of rubber legs 6 are attached to the bottom of the cashdrawer body 4. The cashdrawer apparatus is usually placed on a counter table 8 via the rubber legs 6. The balance weight 5 has a function of preventing the cashdrawer apparatus from leaning forward and falling from the counter table 8, even when the drawer 201 is fully opened (i.e., pulled out) in the forward direction.

The balance weight 5 is laterally offset from an open-and-close mechanism 7 of the drawer 201 so as not to cause interference with the drawer open-and-close mechanism 7. For example, the balance weight 5 is 5 to 6 kg.

Figure 6:
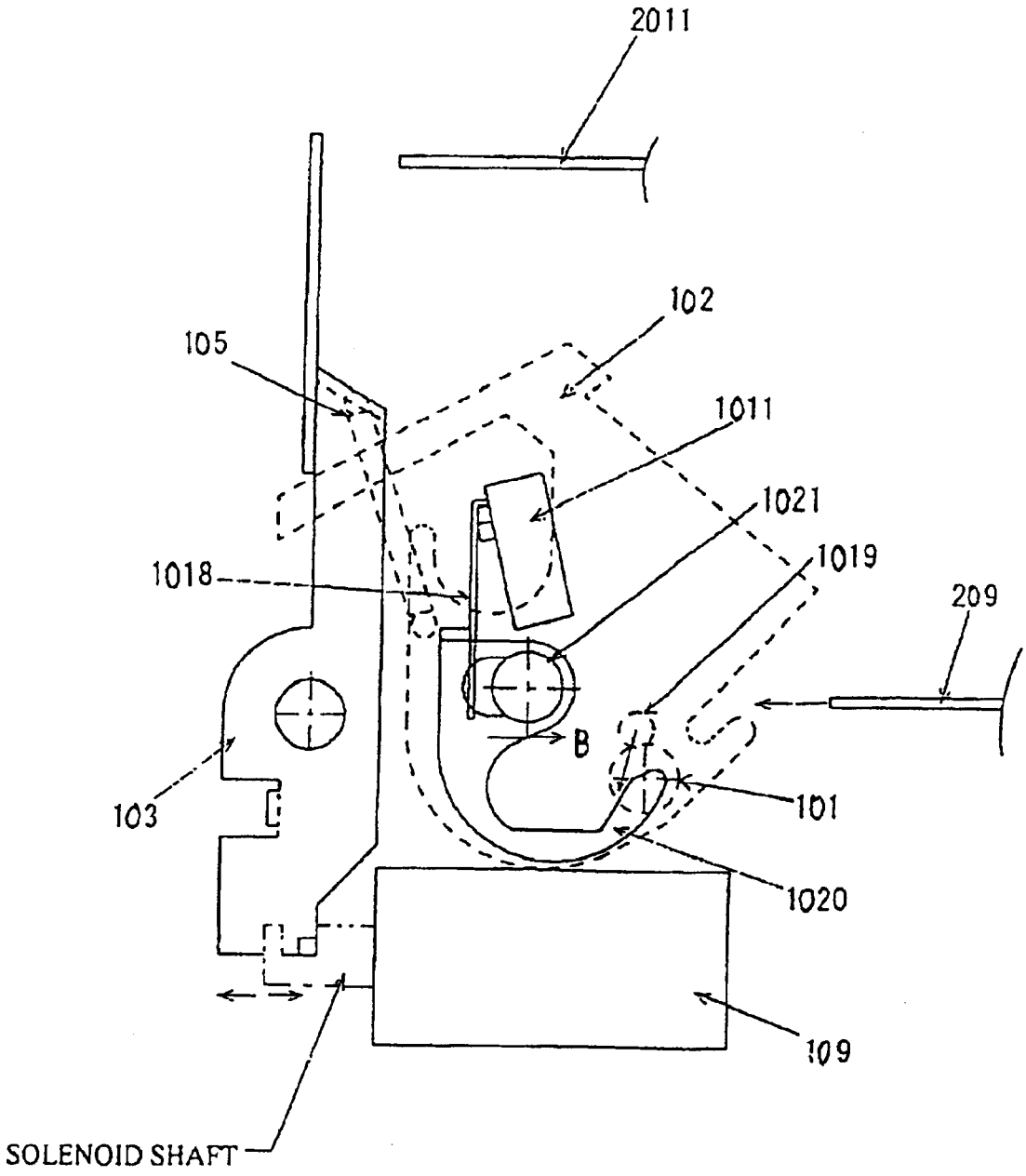
FIG. 6 is a positional relationship between a microswitch and a drawer open-and-close mechanism, in an opened condition of a drawer, in accordance with the preferred embodiment of the present invention.

FIG. 6 shows an opened position of the drawer open-and-close mechanism 7.

To close the drawer 201, the operator pushes the push plate 209 located at a behind side of the drawer 201. The push plate 209 shifts in a direction shown by an arrow (i.e., in the left direction). The push plate 209 pushes the swing lever 102. An engaging shaft 1019 of the swing lever 102 moves in response to the swing motion of the swing lever 102 and hits a free or distal end of an operation lever 1020. The operation lever 1020 shifts in a B direction (i.e., right direction) while being guided by an operation lever shaft 1021. The operation lever 1020 depresses the microswitch lever 1018 to shift a contact of the microswitch 1011 to a closed (i.e., ON) position. In response to each depression of the microswitch lever 1018, the microswitch 1011 counts the number of times the drawer 201 is opened or closed.

Meanwhile, the swing lever 102 swings about its swing shaft 101 in the counterclockwise direction against a resilient force of the spring 105.

Figure 7:
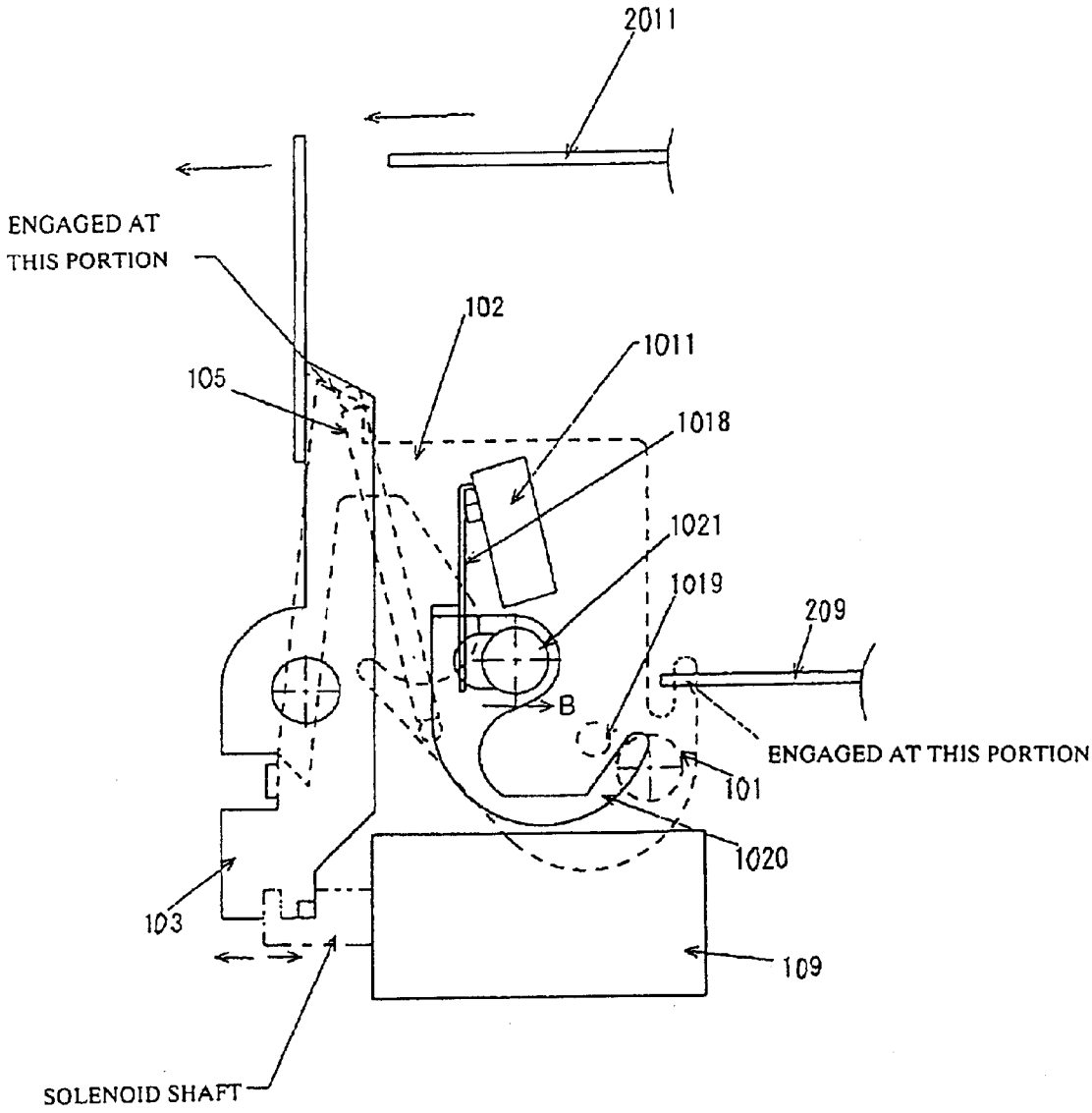
FIG. 7 is a positional relationship between the microswitch and the drawer open-and-close mechanism, in a closed condition of the drawer, in accordance with the preferred embodiment of the present invention.

FIG. 7 shows a closed position of the drawer open-and-close mechanism 7. When the drawer 201 is completely closed, the swing lever 102 engages with the solenoid open lever 103 so as to hold a locked condition. In this locked condition, the engaging shaft 1019 is disengaged or separated from the operation lever 1020. Thus, the engaging shaft 1019 does not push the microswitch lever 1018. Thus, the contact of the microswitch 1011 returns to an opened (i.e., OFF) position.

When the operator inserts a key in the key cylinder 205 and turns the key to open the drawer 201 from the closed condition shown in FIG. 7, the drawer open lever 2011 shifts in a direction shown by an arrow (i.e., in the left direction) and pushes the solenoid open lever 103. The swing lever 102 is disengaged from the solenoid open lever 103 and swings about the swing shaft 101 in the clockwise direction due to the resilient force of the spring 105. The swing lever 102 disengages from the push plate 209 located at the behind side of the drawer 201. Thus, the drawer 201 can be opened.

According to the drawer open-and-close mechanism 7 of the cashdrawer apparatus of the present invention, the microswitch 1011 is depressed by the microswitch lever 1018 only when the engaging shaft 1019 is brought into contact with the operation lever 1020. Thus, even if the swing lever 102 is directly brought into contact with the push plate 209, the microswitch 1011 is not depressed by the microswitch lever 1018. Accordingly, the microswitch lever 1018 is not erroneously depressed when the operator pushes the drawer 201. This surely prevents the chattering of the microswitch 1011. The count value of the microswitch 1011 correctly agrees with actual open or close operations of the drawer 201.

What is claimed is:

1. A cashdrawer apparatus comprising a cash casing for staring banknotes, wherein a banknote holder is installed to the cash casing in a cantilever fashion, said banknote holder includes a holder plate which partitions banknotes stored in said cash easing so that some banknotes can be stored on said holder plate while other banknotes can be stored beneath said holder plate; and said banknote holder includes a banknote depressor for depressing the banknotes stacked on said holder plate.

2. The cashdrawer apparatus in accordance with claim 1, further comprising:

a banknote depressing spring assembled in said banknote holder for giving a resilient force for depressing the banknotes stacked on said holder plate, and a hook equipped at one end of said banknote depressing spring with a diameter larger than a diameter of a main body of said banknote depressing spring, wherein said hook has a hook end directed upward so as to prevent an operator-s finger from being injured by said hook end when the banknotes are stored tri or taken out of the cash casing.

3. The cashdrawer apparatus in accordance with claim 1, further comprising:

a coin casing serving as part of a cash casing; and a banknote insertion slit laterally extending as a clearance between said coin casing and said cash casing.

4. The cashdrawer apparatus in accordance with any one of claims 1 to 3, wherein a balance weight is provided at a rear side of a cashdrawer body so as to prevent the cashdrawer from leaning forward, and said balance weight is positioned so as not to cause interference with a drawer open-and-close mechanism.

5. A cashdrawer apparatus comprising:

a push plate located at a rear end of a drawer;

a swing lever positioned near said push plate and swingable about a swing shaft when said swing lever is pushed by said push plate;

an operation lever engageable with an engaging shaft of said swing lever so as to shift in a predetermined direction during a swing motion of said swing lever, said operation lever disengaging from said engaging shaft of said swing lever when said drawer is closed; and a microswitch operative in response to a shill motion of said operation lever for counting the number of times the drawer is opened or closed, wherein said microswitch is depressed by a microswitch lever which is shiftable together with said operation lever, so that said microswitch is depressed only when said operation lever is engaged with said engaging shaft and shifts in said predetermined direction, thereby preventing chattering of said microswitch.

* * * * *